United States Patent [19]

Ryzner

[11] Patent Number: 4,794,951

[45] Date of Patent: Jan. 3, 1989

[54] BUILT-IN TWO-WAY DIRECTIONAL CONTROL VALVE

[75] Inventor: Clemens Ryzner, Sprockhovel, Fed. Rep. of Germany

[73] Assignee: Paul Pleiger Maschinenfabric GmbH & Co. KG, Witten, Fed. Rep. of Germany

[21] Appl. No.: 76,361

[22] Filed: Jul. 22, 1987

[30] Foreign Application Priority Data

Jul. 24, 1986 [DE] Fed. Rep. of Germany ..... 3625058

[51] Int. Cl.[4] ..... F15B 13/043

[52] U.S. Cl. ..... 137/596.15; 91/454; 137/596.16; 137/596.18

[58] Field of Search ..... 91/454; 137/596.14, 137/596.15, 596.16, 596.18, 637, 637.2

[56] References Cited

U.S. PATENT DOCUMENTS

| | | | |
|---|---|---|---|
| 3,556,144 | 1/1971 | Bickers et al. | 137/596.15 |
| 4,071,046 | 1/1978 | Cates | 91/454 X |
| 4,530,377 | 7/1985 | Peters | 137/637.2 |
| 4,561,464 | 12/1985 | Frantz | 137/596.18 |

FOREIGN PATENT DOCUMENTS

| | | | |
|---|---|---|---|
| 144807 | 11/1980 | German Democratic Rep. | 137/596.18 |
| 396511 | 1/1974 | U.S.S.R. | 137/596.14 |

*Primary Examiner*—Gerald A. Michalsky
*Attorney, Agent, or Firm*—Ladas & Parry

[57] ABSTRACT

A valve having a piston which, by the admission of pressure, is displaceable is a bore of a valve housing for blocking and clearing lines leading through the valve housing, wherein at least one piston (5) is displaceable in an outer piston (3), which inner piston (5) projects beyond the outer piston (3), with a valve seat (6, 7) in each case being allocated to both pistons for blocking and clearing a line.

8 Claims, 5 Drawing Sheets

(A-A)

(B-B)

BUILT-IN TWO-WAY DIRECTIONAL CONTROL VALVE

Figure 1:
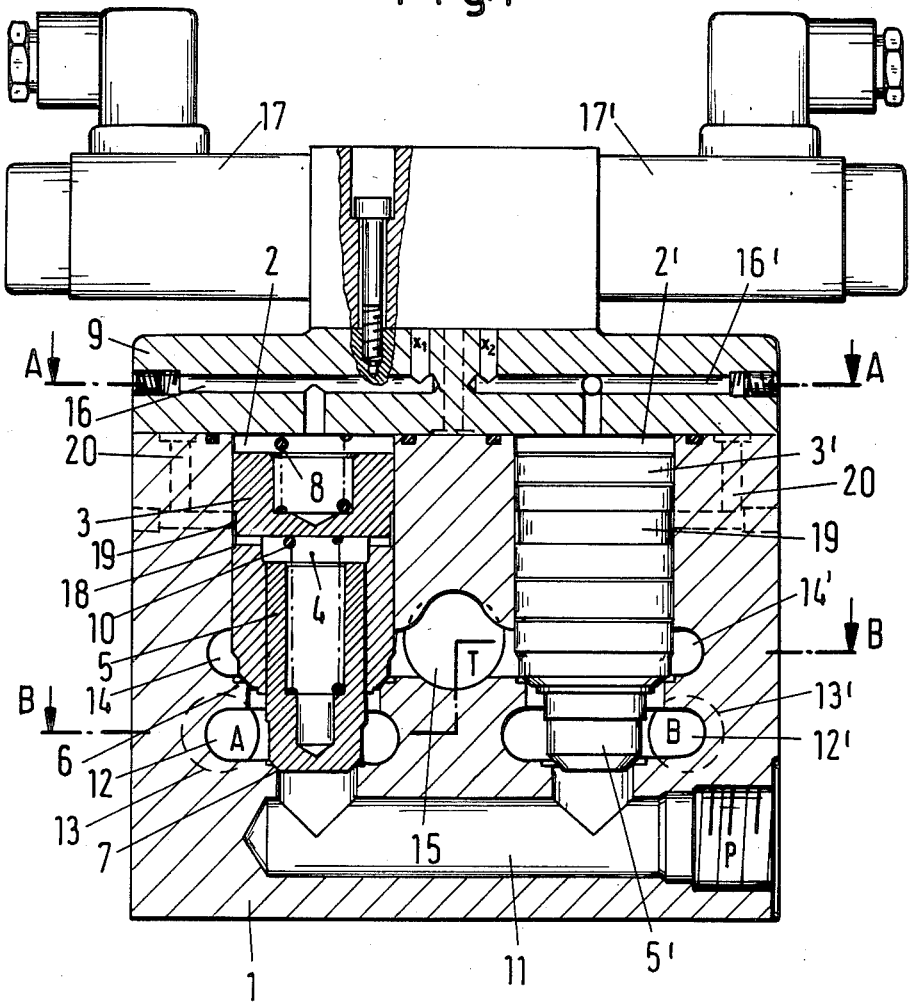

The invention relates to a valve according to the preamble of claim 1.

Valves of this type are known as built-in 2-way directional control valves or as cartridges which are hydraulically controlled indirectly. They essentially consist of the valve housing, a valve piston, a spring acting on the latter, and a lid on which a pilot valve is mounted which, for example, is electrically actuated. Built-in valves of this type, in blocks with appropriate locating and connecting bores, can be combined into the most varied directional-control, flow and pressure-regulating functions. In order to obtain, for example, a 4/3-way directional control function, four built-in 2-way directional control valves can be built into a corresponding block which has connections for pressure and return and two connections for the consuming device and must also contain the necessary locating and connecting bores, with it possibly being necessary for the entire block itself to be fixed on a structure. The dimensions of such a block with four connections are established by the dimensions of the individual built-in valves, the minimum distances of the built-in valves from one another, the requisite connecting bores and the minimum distances of the connecting bores from one another and from the locating bores of the built-in valves. In the case of certain predetermined functions, therefore, the dimensions of a block cannot fall below certain minimum dimensions.

The object of the invention is to design a valve of the type stated at the beginning such that multiple functions are possible in a very compact construction.

This object is achieved by the features in the characterizing part of claim 1. By the nesting of at least two pistons one inside the other, each of which blocks and clears lines, a 4/3-way directional control function, for example, can be achieved in a very compact type of construction. Apart from a material saving on the built-in valves themselves and on the block accommodating them, less drilling work is required on the block. In addition, the position and arrangement of the line bores becomes simpler and neater than in the known assembly of four built-in valves in one block, so that on the whole production can be carried out with considerably less effort and at a low cost. There are only short line paths for the operating medium to be controlled. This is important in particular with regard to heating and efficiency.

Advantageous developments of the invention are specified in the following description and in the further claims.

Figures 2, 4:
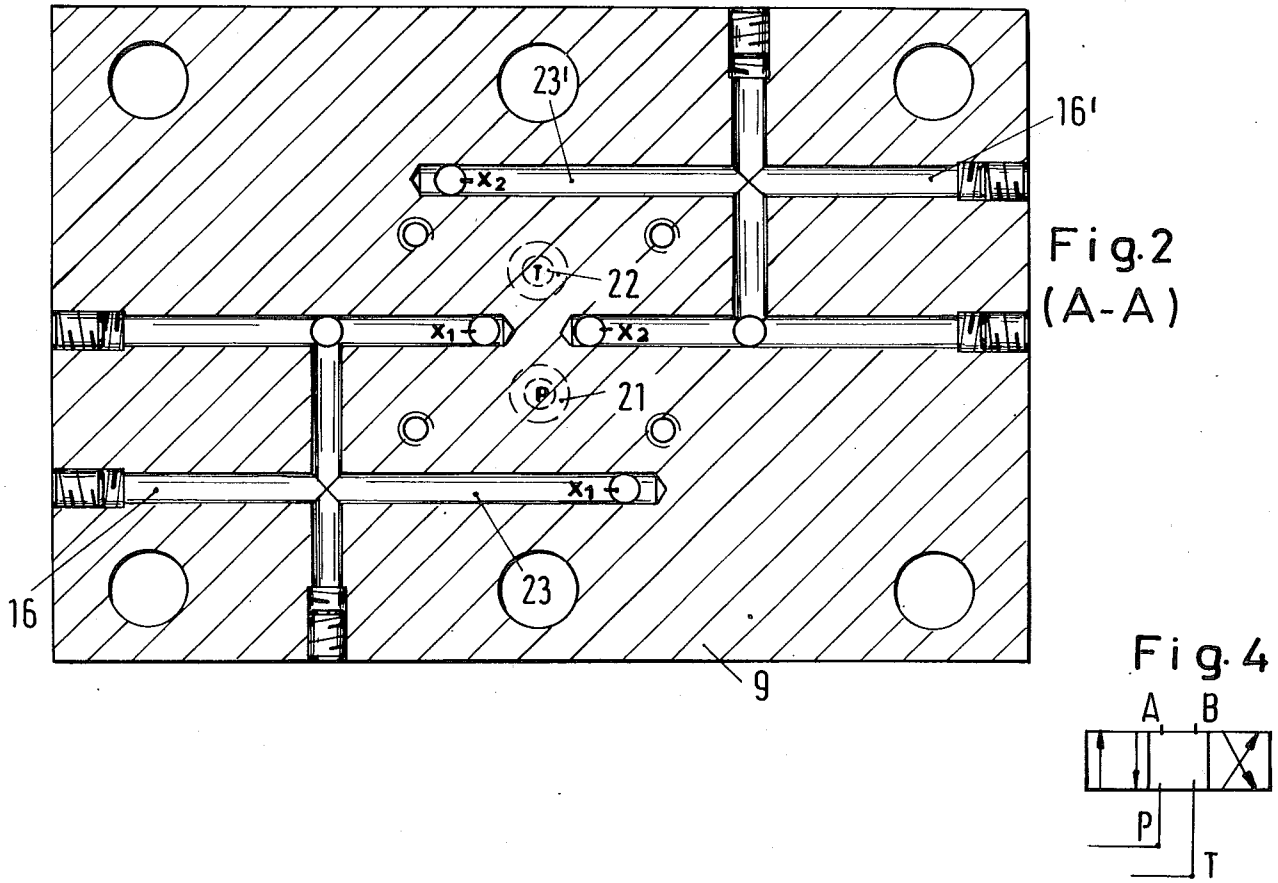
Figure 3:
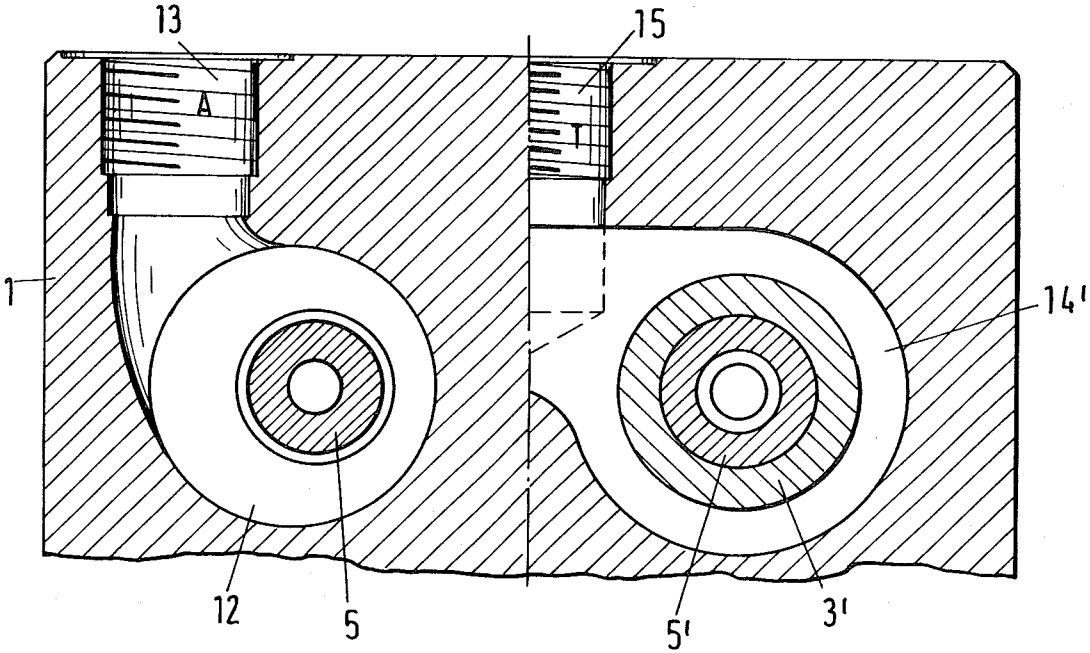
Figure 5:
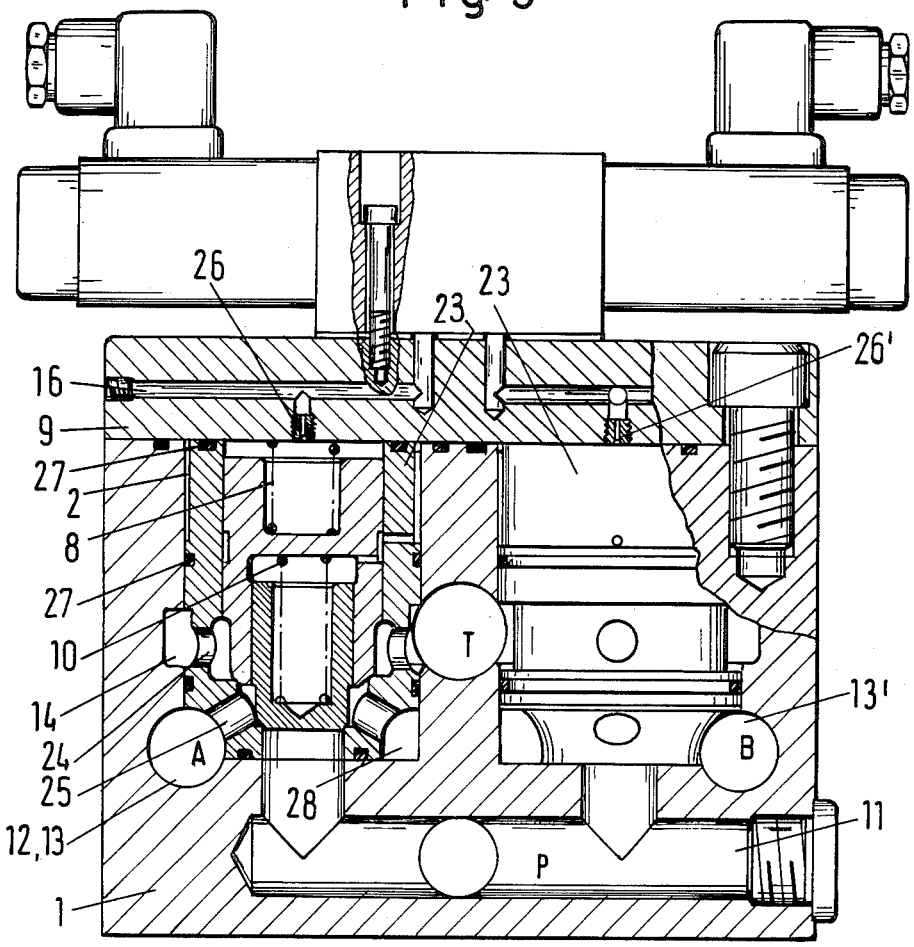
Figure 6:
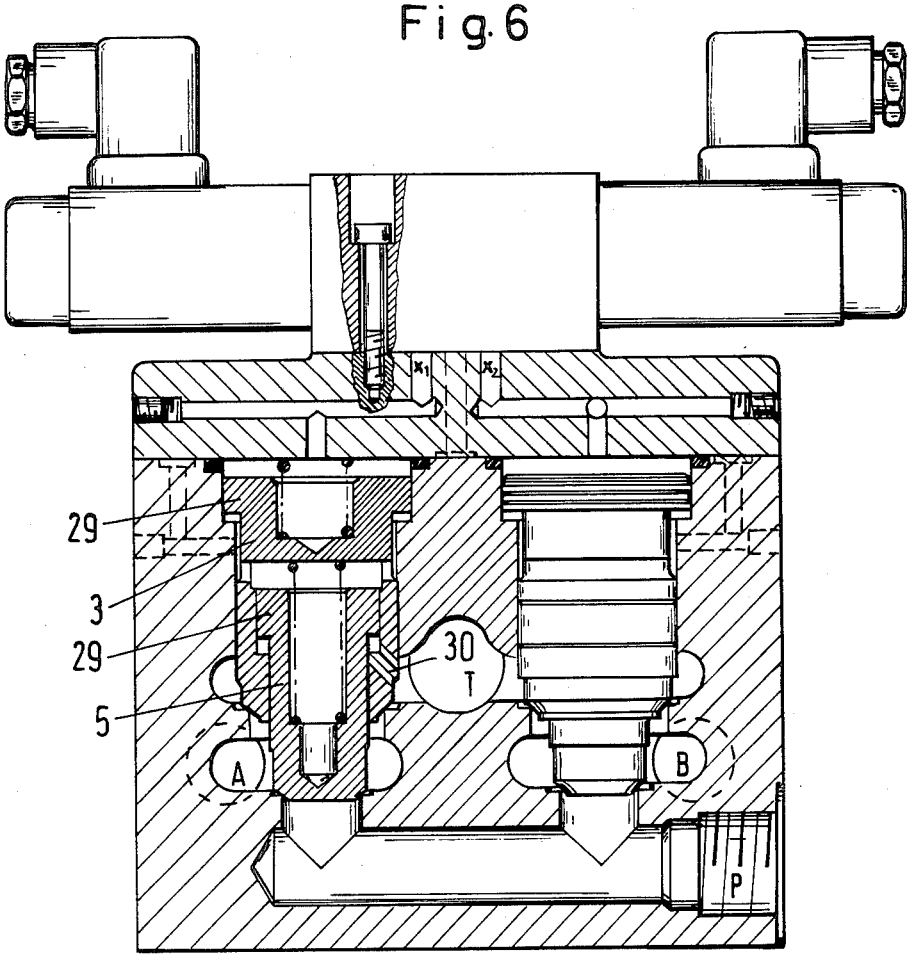

Exemplary embodiments of the invention are described in greater detail below with reference to the drawing, in which:

FIG. 1 shows a section through a built-in valve with two piston arrangements located next to one another, FIG. 2 shows a section along line A—A in FIG. 1, FIG. 3 shows a section along line B—B in FIG. 1, FIG. 4 shows a circuit diagram for the valve according to FIG. 1, FIG. 5 shows a section through another embodiment, and FIG. 6 shows an embodiment in accordance with FIG. 1 with a modified piston form.

Designated as 1 in FIGS. 1 and 3 is a rectangular block in which two bores 2 of the same diameter are made at a distance from one another. Displaceably arranged in these two bores 2 is in each case an outer piston 3, in the center, downwardly open recess 4 of which an inner piston 5 is displaceable which projects on the underside of the outer piston 3. With its front end, the outer piston 3 rests against a valve seat 6 which is made in the bore 2, whereas the inner piston 5 rests against a valve seat 7 which is made in a bore section of smaller diameter. The outer piston 3 is acted upon in the direction of the closed position by a spring 8 which is supported on a lid 9 of the block 1 forming the valve housing and reaches into a blind bore on the upper side of the outer piston 3. The inner piston 5 is acted upon by a spring 10 which is supported on the base of the recess 4 of the outer piston 3 and likewise rests in a blind bore of the inner piston 5.

The circuit diagram for this 4/3-way directional control valve is shown in FIG. 4, with P representing the pressure line, T the return line and A and B consuming devices. In the valve operating position shown, which corresponds to the piston position in FIG. 1, the connections between A and B and P and T are closed, whereas in the two other operating positions the connection P-A and T-B as well as P-B and A-T are possible. In accordance with this circuit diagram, pressure-medium lines are made in the block 1 which are provided with the same letters. The pressure-medium line is made in the form of a bore 11 into which the two bores 2 which accommodate the pistons lead laterally. Thus pressure is present at the two inner pistons 5 on the underside of the respective valve seat 7. An annular groove 12 and 12' is in each case made on the opposite side of these two valve seats 7, which annular groove 12 and 12', as shown by FIGS. 1 and 3, is in each case connected to a connecting bore 13 and 13' which leads to the outside of the block 1. These connecting bores 13 and 13' correspond to the consuming device connections A and B. An annular groove 14 and 14' is likewise made in each case above the two valve seats 6 of the outer pistons 3. These two annular grooves 14 and 14' lead into a common connecting bore 15 which is arranged between the two piston arrangements in the block 1 and represents the return connection T.

In order to achieve the operating position indicated on the left-hand side in FIG. 4, the left-hand inner piston 5 in FIG. 1 must be lifted from the valve seat 7, while the right-hand piston 5' remains resting on the valve seat. At the same time, the right-hand outer piston 3' is lifted from its valve seat so that the annular groove 12' connects with the connecting bore 15. For this purpose, the two bores 2 are stepped in the block 1 in such a way that the bore diameter on the underside of the valve seat 6 is made correspondingly larger than the outside diameter of the piston 5. For the operating position on the right-hand side in FIG. 4 the two piston arrangements are acted upon in the reverse manner so that the left-hand inner piston 5 remains in the closed position while the right-hand inner piston 5' lifts, and the right-hand outer piston 3' remains in the closed position while the left-hand outer piston 3 lifts from the valve seat.

The upper side of the two outer pistons 3 and 3' is acted upon by pressure medium in each case via a line arrangement 16 and 16' made in the lid 9. These two line arrangements 16 and 16', which are shown in detail in FIG. 2, are connected to a pilot valve which has a 4/3-way characteristic and is fixed on the upper side of the lid 9 by means of screws, as shown by FIG. 1. This pilot valve is equipped with two solenoids 17 and 17' which alternatively switch the pilot valve from the center position into one or the other end position. The upper side of the inner pistons 5 and 5', via radial bores 18 in the outer piston 3 and in each case an annular groove 19 on the outer periphery of the outer piston 3, is connected to a pressure-medium line 20 and 20' which is indicated in broken lines in FIG. 1, is made in the block 1 and opens out on the upper side of the latter in a connecting groove.

The line arrangements 16 and 16', which in FIG. 2 are designated as $x_1$ and $x_2$, are in each case connected via a branch 23 and 23' to the line 20' and 20 respectively of the opposite piston arrangement so that, for example when pressure acts on the left-hand outer piston 3, the right-hand inner piston 5' is acted upon by pressure at the same time via the branch 23.

As indicated at 21 and 22 in FIG. 2, the pilot valve is connected to the pressure line P and the return line T in order to control the two piston arrangements in the manner described above. In the operating position shown in FIG. 1 corresponding to the center operating position in FIG. 4, pressure acts on the two line arrangements 16 and 16' so that at the same time pressure likewise acts on the respectively opposite line 20' and 20 and all four pistons are located in the closed position. If the line arrangement 16 is connected to the return while the line arrangement 16' remains under pressure, the right-hand operating position in FIG. 4 results, whereas the left-hand operating position is achieved by connecting the line arrangement 16' to the return and by pressure acting on the line arrangement 16.

FIG. 5 shows a modified embodiment in which the piston arrangement of outer and inner positions is in each case arranged in a sleeve 23 which is inserted in a correspondingly widened bore 2 in the housing block 1. This sleeve is provided with the valve seats 6 and 7, allocated to two pistons, as well as radial penetrations 24 and 25 which are connected to annular grooves 14 and 12 respectively which correspond to the annular grooves 14 and 12 in FIG. 1. Otherwise, the construction of the 4/3-way directional control valve according to FIG. 5 corresponds to that according to FIG. 1. The use of a sleeve 23 has the advantage that this sleeve provided with the valve seats 6 and 7 can be made of high-grade, for example hardened, material, whereas a less expensive material can be used for the block 1. In the event of wear on the valve seats 6 and 7, the sleeve 23 can be exchanged, whereas in the development according to FIG. 1 the block 1 has to be exchanged or the valve seats in this block 1 have to be machined.

A choke 26 and 26' which permits dampened or delayed operation is in each case inserted into the line arrangements 16 and 16'. These chokes can be omitted if rapid operations or short operating times are desired. Such chokes can also be provided in the lines 20 and 20'.

In order to save material and space, the sleeve 23 can be made with a wall thickness which is only just permissible. It is provided with annular seats 27 for sealing the individual line sections. In a corresponding manner, seals are provided on the end faces of the sleeve 23 and between the block 1 and the lid 9.

A separate annular groove can be omitted by a reduction in the diameter of the sleeve 23 at the lower section, as shown by FIG. 5. Instead of an annular groove, an annular channel 28 which is connected to the connecting bores 13 and 13' running tangentially thereto remains in the cylindrical bore 2 as a result of the reduction in diameter at the front end of the sleeve 23.

FIG. 6 shows an embodiment in accordance with FIG. 1, with the inner and outer pistons being designed as stepped pistons. This enables a shorter operating time to be achieved as a result of the respectively larger piston area on the upper side of the two pistons than on the opposite lower side, with an increased pressure on the valve seat and thus a better seal also resulting when pressure acts on the upper side. At the top end, each piston is provided with a collar 29, adjoining which is a cylindrical section of smaller diameter. So that the inner piston 5 can be used in the outer piston 3, the latter must be of a two-piece design. The annular space on the underside of the collar 29 on the inner piston 5 is constantly connected to the return side by a radial bore 30 in the outer piston 3. It is also possible to provide a sleeve 23 in this embodiment with stepped pistons.

Various modifications of the type of construction described are possible. Thus the two piston arrangements can be designed with different diameters in accordance with the particular requirements. Moreover, it is possible to combine several of such 4/3-way directional control valves into a larger control unit. In corresponding manner, it is also possible to insert in a block 1 several built-in valves in the form of piston arrangements of inner and outer pistons, in which case various operating functions of the valve thus constructed can be achieved by an appropriate arrangement of the lines in the lid 9 and in the block 1. Thus not only can 4/3-way directional control valves be designed, as described in greater detail by way of example with reference to the figures, but all forms of 3-way and multi-way directional control valves having two and more operating positions.

According to a further development, several inner pistons nesting one inside the other can be arranged in an outer piston, with the individual pistons which nest one inside the other each projecting in stepped manner beyond the surrounding piston, and a valve seat being allocated to each piston, as described with reference to the exemplary embodiment for two pistons 3 and 5 nesting one inside the other. Thus, for example, three or four pistons can nest one inside the other.

For the various operating functions, even in a piston arrangement with two pistons nesting one inside the other, the piston arrangements can be cut by at least half compared with a type of construction having individual valves or individual piston arrangements, so that manufacture is simplified, because the connecting lines can be arranged more simply, whereby short line paths and low flow resistance for the operating medium result. The dimensions can be kept correspondingly smaller than in individual valves, and finally the costs of control devices are reduced with built-in valves according to the invention.

I claim:

1. A valve comprising:

a block having at least one bore in the block;

an outer valve seat within the bore;

an outer piston displaceably arranged in the bore, having an upper side and a lower side, wherein pressure is supplied to the upper side, said outer piston being operable to open and close pressure lines in the block;

an outer spring means, adjacent to the outer piston, to press the outer piston into engagement with the outer valve seat;

at least one inner valve seat, having a smaller diameter than the outer valve seat, formed at an indentation in the bore;

at least one inner piston, displaceably arranged within a blind bore that is coaxially aligned and within the outer piston, having a front end that projects beyond the outer piston, said inner piston being operable to open or close pressure lines in the block;

at least one inner spring means, adjacent to the inner piston and within the blind bore to press the inner piston into engagement with the inner valve seat; and at least one pressure-medium line, connected to a pressure supply means and a radial bore in the outer piston, for supplying pressure between the outer piston and the inner piston.

2. The valve as claimed in claim 1, wherein a first and a second piston arrangement of the inner and outer pistons are inserted into at least two bores that are spaced from one another within the block to form a 4/3-way directional control valve, and wherein a lid, attached to the block to form a valve housing, has at least one line arrangement therein.

3. The valve as claimed in claim 2, wherein the line arrangements in the lid and the pressure-medium lines in the block supply pressure to the outer piston and the inner piston; and at least one pilot valve, connected to the line arrangements and the lid, to alternately open and close the line arrangements so as to distribute pressure to the inner piston of the first piston arrangement and the outer piston of the second piston arrangement, while the outer piston of the first piston arrangement and the inner piston of the second piston arrangement are connected to a return connection, and vice versa.

4. The valve as claimed in claim 1, wherein at least two annular grooves, within the block and respectively adjacent to the outer valve seat and the inner valve seat, are respectively connected to at least one connecting bore in the block.

5. The valve as claimed in claim 1, wherein a piston arrangement of the inner piston and the outer piston is inserted in a sleeve, having an outer valve seat, an inner valve seat and at least one radial penetration, said sleeve is inserted into the bore in the block.

6. The valve as claimed in claim 5, wherein the sleeve, at a front end, has a section of reduced outside diameter and is inserted into the bore in the block.

7. A valve according to claim 5 wherein the valve seats are stationary within the block.

8. The valve as claimed in claim 1, wherein at least one choke is connectable to the pressure-medium lines and to at leat one line arrangement, said line arrangement is within a lid attached to the block.

* * * * *